US007775322B2

(12) United States Patent
Hill

(10) Patent No.: US 7,775,322 B2
(45) Date of Patent: Aug. 17, 2010

(54) SNAP-ACTION VALVE FOR EXHAUST SYSTEM

(75) Inventor: William E. Hill, Ann Arbor, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 88 days.

(21) Appl. No.: 12/041,114

(22) Filed: Mar. 3, 2008

(65) Prior Publication Data

US 2008/0223025 A1 Sep. 18, 2008

Related U.S. Application Data

(63) Continuation-in-part of application No. 11/687,151, filed on Mar. 16, 2007, now Pat. No. 7,434,570.

(51) Int. Cl.
*F01N 1/00* (2006.01)

(52) U.S. Cl. ..... 181/254; 181/237; 181/212; 181/247; 60/324

(58) Field of Classification Search ..... 181/212, 181/247, 237, 254; 60/324
See application file for complete search history.

(56) References Cited

U.S. PATENT DOCUMENTS 1,613,322 A * 1/1927 Goetz ..... 181/254
1,709,426 A * 4/1929 Beery ..... 181/254
1,840,082 A * 1/1932 Breer ..... 181/254
1,860,892 A 5/1932 Gray
2,072,372 A 3/1937 Kingsley
2,157,030 A * 5/1939 Starkweather et al. ..... 181/254
2,556,277 A 6/1951 Hill et al.
3,406,783 A * 10/1968 Haffer ..... 181/247
3,703,937 A 11/1972 Tenney
4,264,344 A * 4/1981 Ludecke et al. ..... 55/313

(Continued)

FOREIGN PATENT DOCUMENTS

JP 1997-303143 A 11/1997

(Continued)

OTHER PUBLICATIONS

PCT International Search Report dated Aug. 6, 2009, from counterpart PCT international application No. PCT/US2009/030820.

(Continued)

*Primary Examiner*—Jeffrey Donels
*Assistant Examiner*—Forrest M Phillips
(74) *Attorney, Agent, or Firm*—Harness, Dickey & Pierce, P.L.C.

(57) ABSTRACT

A passive, exhaust pressure actuated valve assembly for placement inside a tubular exhaust conduit is pivotally mounted to an off-center axle for rotation between fully closed and fully opened positions. A bias element forces the valve flap toward the fully closed position. The valve flap is shaped in a manner enabling use of the interior surface of the exhaust conduit to define stops at the full closed and full opened positions. The valve flap shape, in conjunction with the bias element arrangement, enables the flap to lie substantially parallel to a longitudinal axis of the conduit in the fully opened position, which provides for minimum back pressure in the conduit. The valve assembly finds particularly advantageous use inside a bypass through pipe of a muffler assembly.

12 Claims, 5 Drawing Sheets

U.S. PATENT DOCUMENTS

| | | | | | |
|---|---|---|---|---|---|
| 4,356,801 | A | | 11/1982 | Graham | |
| 4,565,176 | A | | 1/1986 | Alf et al. | |
| 4,707,987 | A | * | 11/1987 | Atkin | 60/324 |
| 4,805,571 | A | | 2/1989 | Humphrey | |
| 4,903,486 | A | | 2/1990 | Finkle | |
| 5,355,673 | A | * | 10/1994 | Sterling et al. | 60/324 |
| 5,392,812 | A | * | 2/1995 | Herron | 137/527.8 |
| 5,581,056 | A | * | 12/1996 | Bellgardt et al. | 181/282 |
| 5,633,482 | A | * | 5/1997 | Erion et al. | 181/282 |
| 5,692,374 | A | | 12/1997 | Seki et al. | |
| 5,723,829 | A | | 3/1998 | Inomata et al. | |
| 5,739,483 | A | | 4/1998 | Yashiro et al. | |
| 5,744,762 | A | | 4/1998 | Seki et al. | |
| 5,749,335 | A | | 5/1998 | Flanery et al. | |
| 5,801,343 | A | | 9/1998 | Suzuki et al. | |
| 5,821,474 | A | | 10/1998 | Olszok et al. | |
| 5,971,098 | A | | 10/1999 | Suzuki et al. | |
| 6,189,650 | B1 | | 2/2001 | Inuzuka et al. | |
| 6,499,562 | B1 | | 12/2002 | Elfinger et al. | |
| 6,527,006 | B2 | | 3/2003 | Jackson | |
| 6,553,963 | B1 | | 4/2003 | Noble | |
| 6,564,902 | B1 | | 5/2003 | Saberi | |
| 6,581,721 | B2 | | 6/2003 | Nagai et al. | |
| 6,598,390 | B2 | * | 7/2003 | Chang | 60/323 |
| 6,604,516 | B1 | | 8/2003 | Krimmer et al. | |
| 6,640,927 | B1 | | 11/2003 | Turner | |
| 6,732,511 | B2 | | 5/2004 | Unbehaun et al. | |
| 2006/0272322 | A1 | | 12/2006 | Abram et al. | |

FOREIGN PATENT DOCUMENTS

| | | | |
|---|---|---|---|
| JP | 1998-141041 | A | 5/1998 |
| KR | 10-1998-0002656 | A | 3/1998 |
| KR | 10-1998-0009780 | A | 4/1998 |
| KR | 10-2001-0038902 | A | 5/2001 |

OTHER PUBLICATIONS

PCT Written Opinion of the International Search Authority dated Aug. 6, 2009, from counterpart PCT international application No. PCT/US2009/030820.

* cited by examiner

SNAP-ACTION VALVE FOR EXHAUST SYSTEM

RELATED APPLICATION

This is a continuation-in-part of commonly owned U.S. application Ser. No. 11/687,151 filed Mar. 16, 2007, the disclosure of which is incorporated herein by reference in its entirety.

BACKGROUND

Field

The invention generally relates to valve arrangements for vehicle exhaust systems. More specifically, the present teachings pertain to passive flapper valves for exhaust conduits.

Many exhaust systems have attempted to use both active and passive valve assemblies to alter the characteristics of exhaust flow through a conduit as the exhaust pressure increases due to increasing engine speed. Active valves carry the increased expense of requiring a specific actuating element, such as a solenoid. Passive valves utilize the pressure of the exhaust stream in the conduit with which the valve is associated.

Traditionally, even passive valves at their lower expense give rise to problems of unwanted back pressure when the valve is open. There is seen to be a need in the art for a passive valve arrangement which may be utilized totally inside a conduit, which is relatively inexpensive, and is capable of assuming a fully open position which minimizes unwanted back pressure.

SUMMARY

In one aspect of the disclosed teachings, a muffler for an internal combustion engine exhaust system includes a housing having an outer shell and input and output headers enclosing opposite ends of the shell. At least one partition inside the housing divides a housing interior into first and second chambers. At least one of the chambers has sound absorbing material positioned therein, the at least one partition having at least one aperture therethrough providing for fluid communication between the first and second chambers. A through pipe extends through the input and output headers and the at least one partition and has a plurality of perforations enabling fluid communication between the through pipe and the first chamber. A valve assembly has a valve flap positioned inside the through pipe for rotation about an axle pivotally coupled to the pipe between a fully closed position wherein a first peripheral portion of the valve flap is in contact with an inner surface of the through pipe and a fully open position wherein a plane of the valve flap is substantially parallel to a longitudinal axis of the through pipe and a second peripheral portion of the valve flap is in contact with an inner surface of the through pipe.

In another aspect of the disclosed teachings, a muffler for an internal combustion engine exhaust system includes a housing having an outer shell and input and output headers enclosing opposite ends of the shell. First and second partitions inside the housing divide a housing interior into first, second and third chambers, the first chamber defined by the first partition and the input header, the second chamber defined by the second partition and the output header, and the first and second partitions defining the third chamber therebetween. The first and second partitions have at least one aperture therethrough providing fluid communication between the first and second chambers via the third chamber. The first and second chambers each have sound absorbing material positioned therein. A through pipe extends through the input and output headers and the first and second partitions and has a first plurality of partitions enabling fluid communication between the through pipe and the first chamber, and a second plurality of perforations enabling fluid communication between the through pipe and the second chamber. A valve assembly has a valve flap positioned inside the through pipe in the third chamber between the first and second pluralities of through pipe perforations for rotation about an axle pivotally coupled to the pipe between a fully closed position wherein a first peripheral portion of the valve flap is in contact with an inner surface of the through pipe and a fully open position wherein a plane of the valve is substantially parallel to a longitudinal axis of the through pipe and a second peripheral portion of the valve flap is in contact with an inner surface of the through pipe.

BRIEF DESCRIPTION OF THE DRAWING

The objects and features of the disclosed teaching will become apparent from a reading of the detailed description, taken in conjunction with the drawing, in which.

DETAILED DESCRIPTION

Figure 1A:
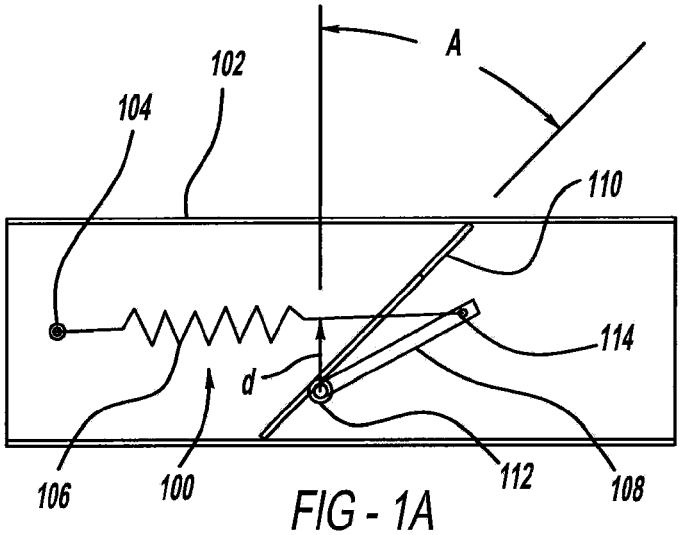
FIGS. 1A, 1B are respective side and end views of a valve controlling fluid flow through a conduit, the valve being in a closed position and arranged in accordance with the disclosed teachings.

With reference to FIGS. 1A-4B, side and end views of a valve assembly with a valve flap in various operative positions is shown in side and end views of the conduit in which the valve assembly is positioned. Identical elements among these Figures carry the same last two designation numerals.

An exhaust conduit 102 contains a snap-action valve 100 which includes a spring anchor 104, a valve spring 106, an external lever arm 108, a valve flap 110, a valve support shaft or axle 112 and a spring attachment arm 114 protruding from axle 112.

Valve flap 110 has first and second arcuate edges substantially conforming to an interior arcuate surface of conduit 102. Flapper 110 additionally has linear side edges 116 and 118 which provide clearance 120, 122 between flapper 110 and an interior surface of conduit 102 when the flap is in the closed position shown in FIGS. 1A and 1B. Bias element or spring 106 extends between an anchor point 104 on conduit 102 and attachment point 114 of external lever arm 108. Spring 106 biases flapper 110 toward the closed positioned shown in FIG. 1A. When in the fully closed position, flap 110 resides at an angle other than 90° to a plane extending normal to the longitudinal axis of conduit 102. The angle of the flap with respect to a cross-sectional normal plane of conduit 102 is designated A.

Figure 4A:
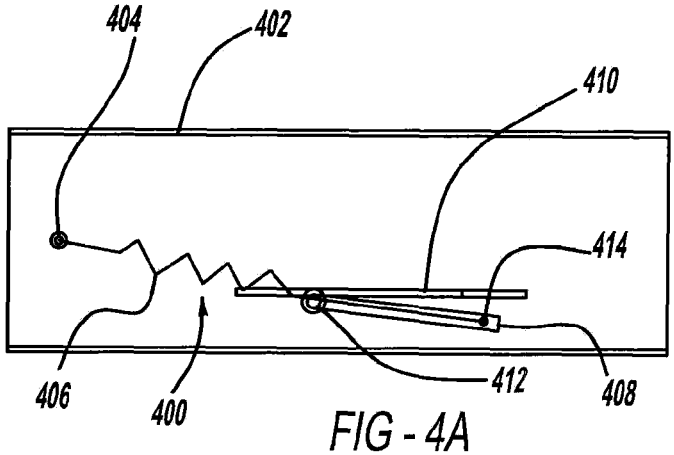
FIGS. 4A, 4B are respective side and end views of the valve of FIGS. 1A, 1B in a fully open position.
Figure 4B:
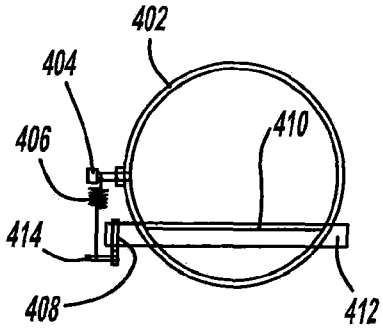

In operation, exhaust pressure is incident on flap 110 from the left as viewed in FIGS. 1A-4B. When the exhaust pressure is sufficient to overcome the bias force of spring 106, the flap 110 will start to rotate about axle 112. The torque on valve flap 110 is determined by the bias spring force multiplied by the distance d which is the distance d between the axis of the spring and axle 112. The spring force increases as the valve flap opens and the spring 106 stretches. However, d gets shorter as the valve continues to open resulting in the torque approaching zero as the longitudinal axis of the spring approaches an "over-center" position—i.e., as it approaches intersection with a longitudinal axis of the axle 112. This nearly over-center positioning of the valve flap as shown at 410 in FIG. 4A and FIG. 4B results in a substantially horizontal position of the flap when in the fully open position. This positioning, in turn, minimizes back pressure in the conduit when the valve is in the fully open position. Additionally, it is to be noted that the conduit itself supplies the stop mechanism for the valve flap in both its fully closed and fully opened positions. In the fully closed position, the arcuate edges of flap 114 contact the interior surface of conduit 102 to define that position. Conversely, when in the fully opened position, as shown in FIGS. 4A and 4B, flap 410 utilizes its lateral linear edges (116 and 118 of FIG. 1B) to come into contact with the inner surface of conduit 402 to thereby provide a stop position for the fully opened position of flap 410.

Rotating the valve flap such that the spring approaches the over-center condition also results in an easier maintenance of the valve in the fully opened position.

Figure 5A:
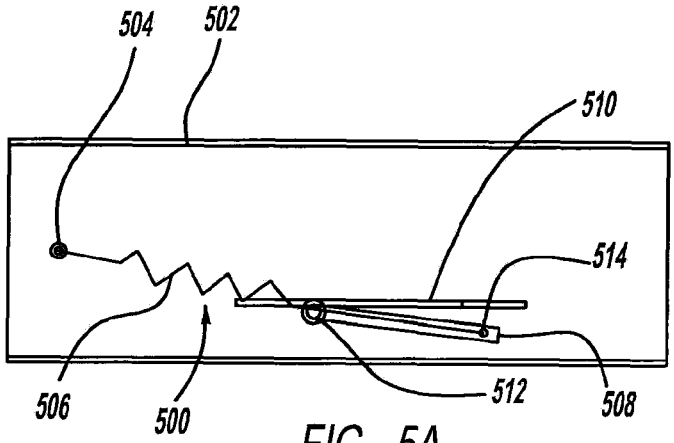
FIGS. 5A, 5B are respective side and end views of a first valve axle arrangement in accordance with the present teachings.
Figure 5B:
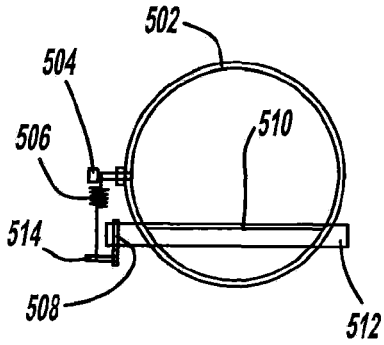

FIGS. 5A and 5B show a first axle arrangement suitable for use with the valve assembly disclosed herein. Valve flap 510 rotates within conduit 502 about axle 512 which is placed asymmetrically with respect to the plane of flap 510. A bias spring 506 extends between anchor point 504 and an attachment point 514 on lever arm 508. As seen from FIG. 5B, axle 512 which is journaled to conduit 502 via appropriate apertures, extends only so far at its leftmost end as shown in FIG. 5B so as to provide clearance between the axle 512 and spring 506. With this clearance, the spring goes to near over-center and holds that position until the exhaust flow pressure is reduced significantly. At that point, the valve flap snaps to the closed position. Lever arm 508 protrudes from axle 512 either as a separately attachable element or as an integral protrusion of axle 512.

Figure 6A:
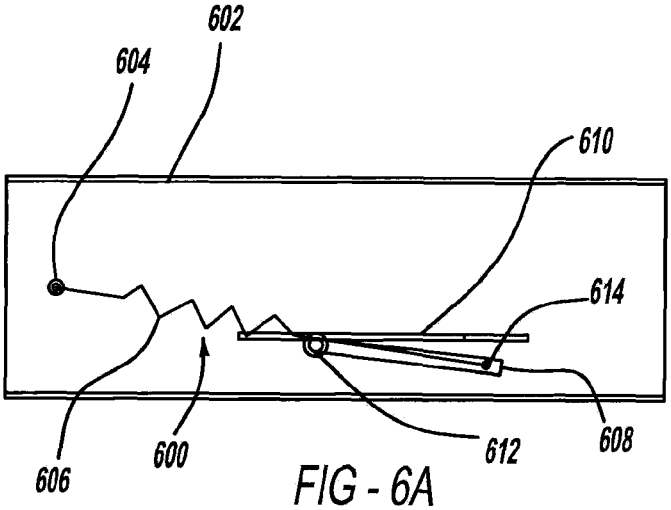
FIGS. 6A, 6B are respective side and end views of a second valve axle arrangement in accordance with the present teachings.
Figure 6B:
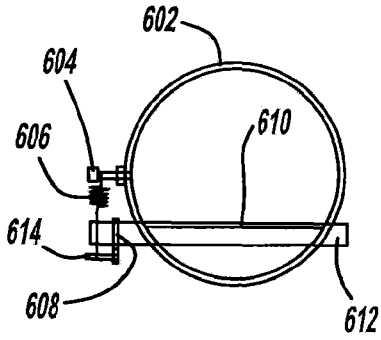

FIGS. 6A and 6B depict an alternative axle arrangement for use with the valve assembly disclosed. In this arrangement axle 612 extends outwardly of the conduit for a distance sufficient that it intersects the ultimate location of spring 606 when in its fully extended position. Hence, in this arrangement, spring 606 will contact axle 612 and wrap around it when the fully opened position is achieved. With this arrangement, since spring 606 wraps around axle 612, the spring will pull the flap 610 to the closed position as soon as the exhaust flow pressure is reduced to a level unable to overcome the spring force.

Figure 1B:
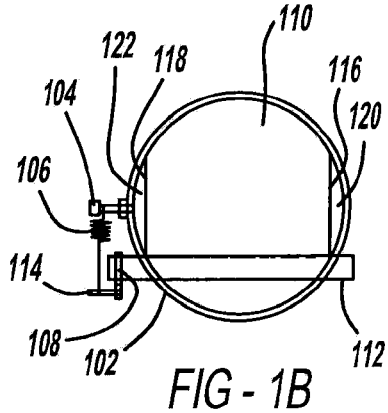
Figure 2A:
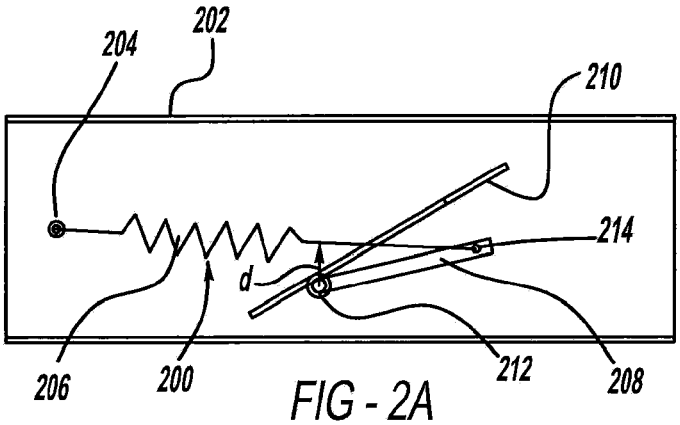
FIGS. 2A, 2B are respective side and end views of the valve of FIGS. 1A, 1B in a 15° open position.
Figure 2B:
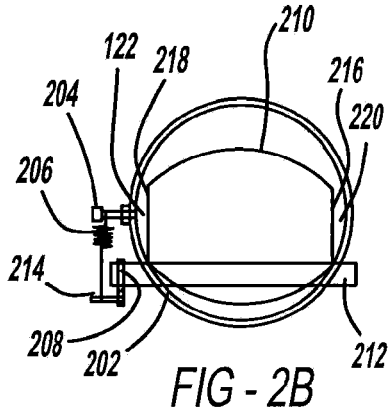
Figure 3A:
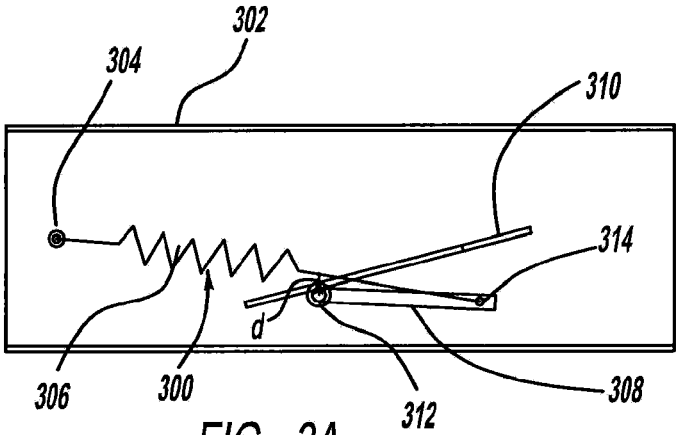
FIGS. 3A, 3B are respective side and end views of the valve of FIGS. 1A, 1B in a 30° open position.
Figure 3B:
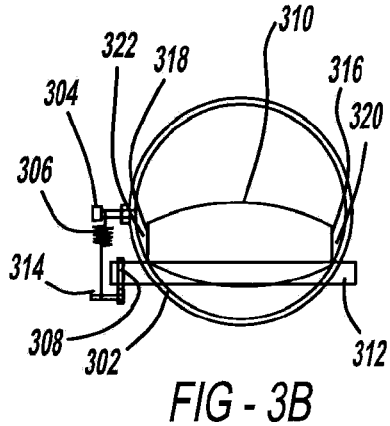
Figure 7:
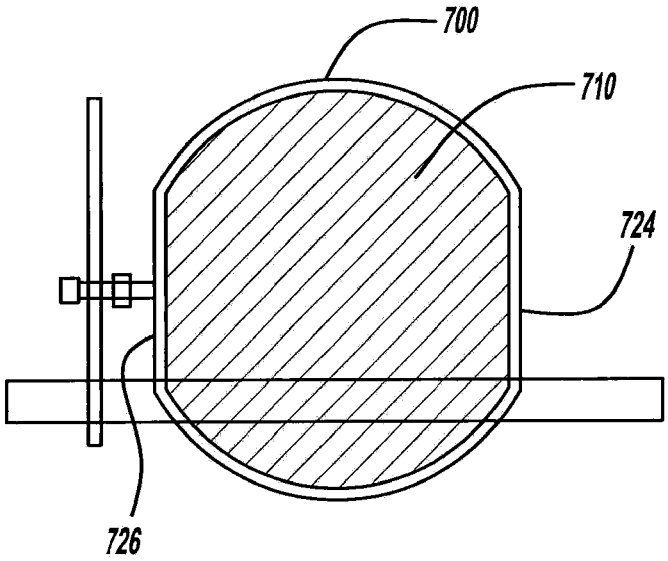
FIG. 7 is an end view of the valve of FIGS. 1A and 1B with the pipe contacting the valve flap altered to achieve substantially full blockage of the pipe when the valve is placed in the fully closed position.

FIG. 7 depicts one approach to achieving nearly full closure of the exhaust conduit by the disclosed valve assembly when the valve flap is put in its fully closed position. As seen from FIG. 77 clearance areas such as 120 and 122 of FIG. 1B are substantially eliminated by flattening sides of conduit 700 such that it conforms more nearly to the overall peripheral shape of valve flap 710. Section 724 and section 726 are flattened areas of conduit 700 to more nearly parallel the linear first and second edges of valve flap 710. Of course it will be apparent to those skilled in the art that some clearance between the linear edges of valve flap 710 and conduit walls 724 and 726 must be present to prevent jamming of the valve flap upon rotating.

Figure 8:
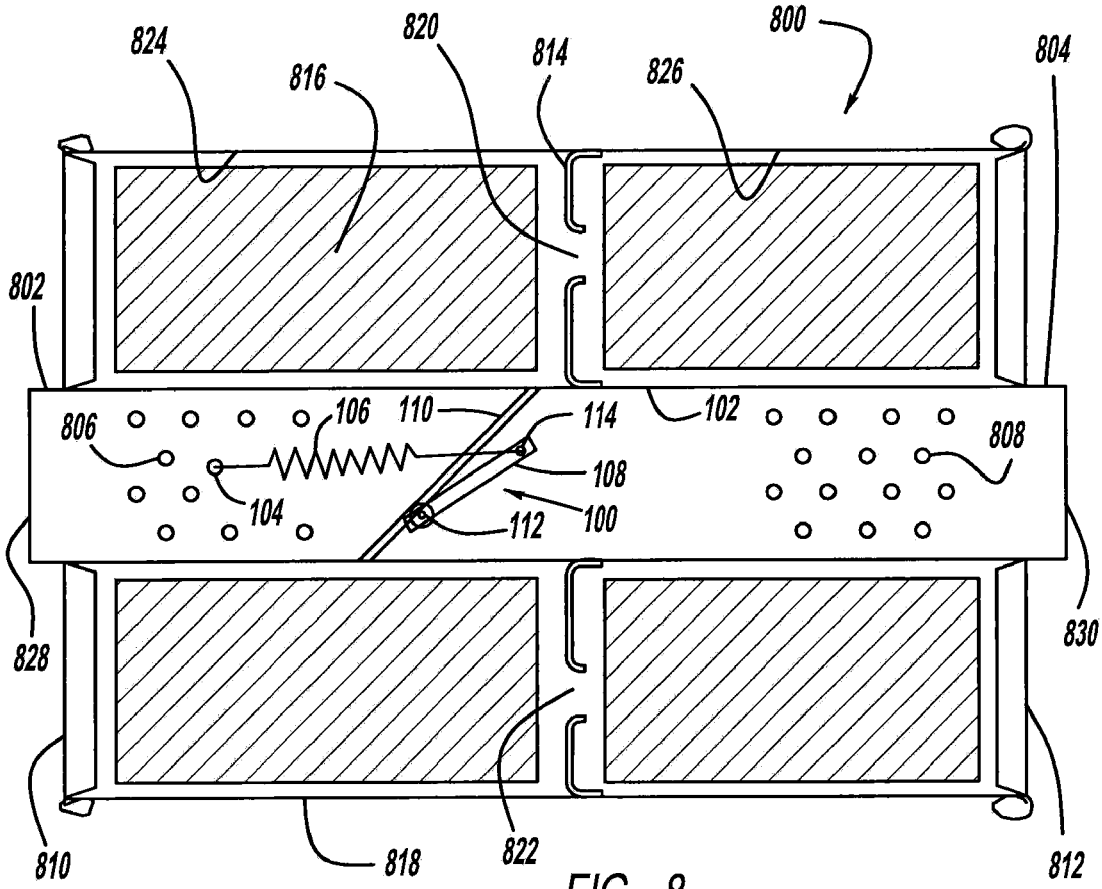
FIG. 8 is a side cross-sectional view of an exhaust muffler arranged with the valve of FIGS. 1A, 1B in accordance with the present teachings.

An exemplary application of the disclosed valve assembly is for an automotive exhaust system muffler, such as that shown in FIG. 8.

Muffler 800 has a housing comprised of a substantially cylindrical outer shell 818 closed at input and output ends by an input header 810 and an output header 812. A partition 814 is attached to outer shell 818 at a position to define muffler chambers 824 and 826 on either side thereof. Partition 814 additionally includes at least one aperture 820, 822 enabling fluid communication between the chambers 824 and 826 inside muffler 800. Optionally, sound absorbing material 816 may be placed in one or both interior muffler chambers.

Extending through muffler 800 by passing through input header 810, partition 814 and output header 812 is a through pipe 802. Pipe 802 includes a first plurality of perforations 806 enabling an input section of pipe 802 to have fluid communication with the muffler chamber 824 surrounding it. Pipe 802 has a second plurality of perforations 808 at an output end enabling fluid communication from the chamber 826 surrounding it to pipe 802.

Positioned between the first and second set of perforations of pipe 802 is a valve assembly 100 arranged as previously described in conjunction with FIGS. 1A-4B. Hence, in the closed position of valve assembly 100, exhaust will enter muffler 800 at the input end 828 of pipe 802 as seen in FIG. 8 and will flow through perforations 806 into the sound absorbing material 816 surrounding the pipe in chamber 824. The exhaust then flows from the first chamber 824 to the second chamber 826 via apertures 820, 822 in partition 814. Finally, the exhaust flows from the second chamber 826 through perforations 808 in through pipe 802 and out an exit end 830 of the pipe 802 as seen from FIG. 8.

When the exhaust pressure is high enough to overcome the force of bias spring 106, the valve flap 110 will open to a nearly horizontal position within pipe 802 to essentially have most of the exhaust gas bypass the first and second chambers and their associated sound absorbing material. Since the flap 110 will be substantially horizontal in FIG. 8 in the fully open position, back pressure in muffler 800 is minimized.

Figure 9:
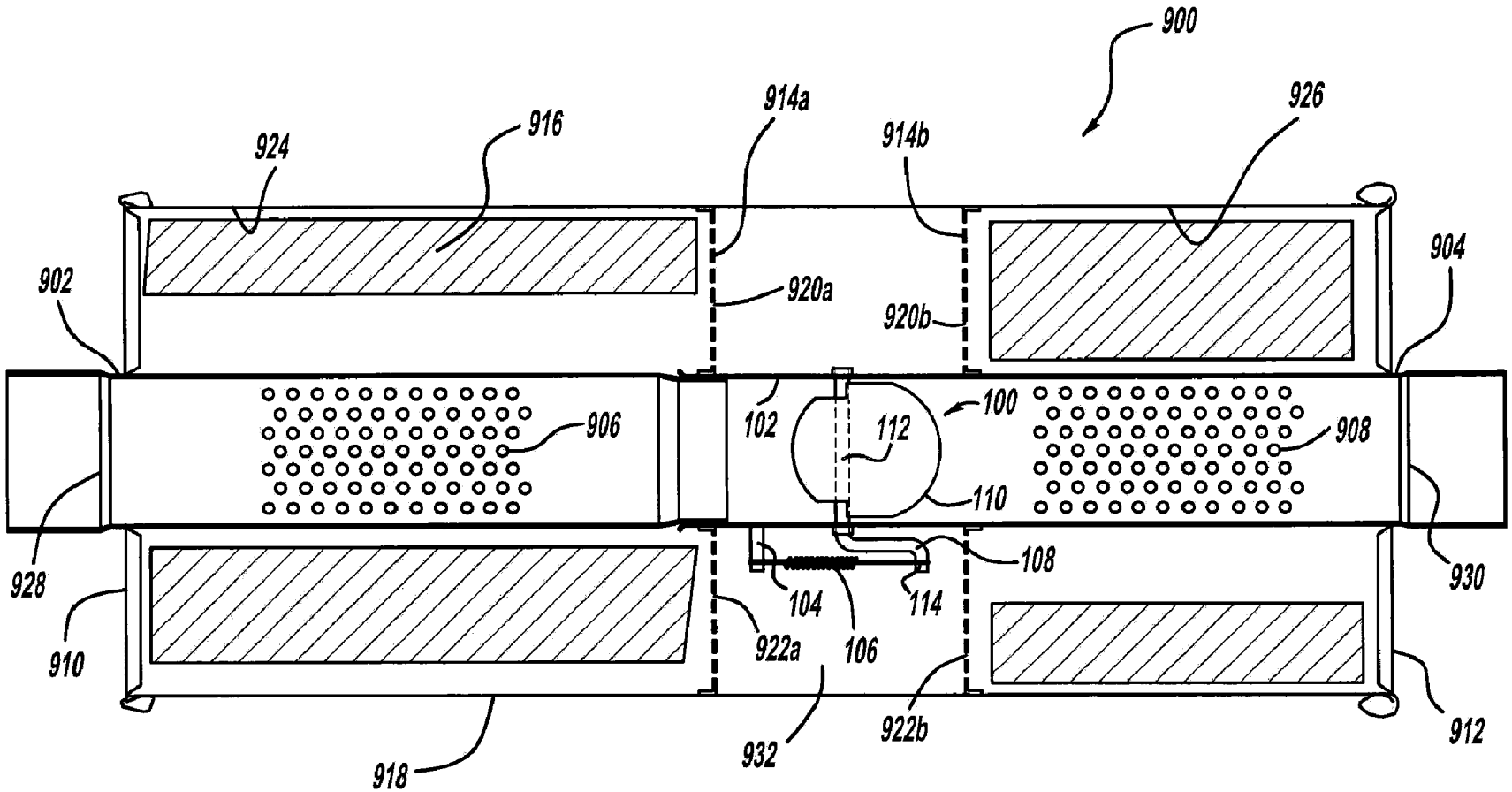
FIG. 9 is a side cross-sectional view of a first alternative embodiment of an exhaust muffler arranged with a flapper valve in accordance with the present teachings.

Another exemplary application of the disclosed valve assembly is for a first alternative automotive exhaust system muffler, such as that shown in FIG. 9.

Muffler 900 has a housing comprised of a substantially cylindrical outer shell 918 closed at input and output ends by an input header 910 and an output header 912. A first partition 914*a* is attached to outer shell 918 at a position to define first muffler chamber 924 on a first side thereof. A second partition 914*b* is attached to outer shell 918 at a position to define a second muffler chamber 926 on a first side thereof. The second sides of partitions 914*a* and 914*b* define a third muffler chamber 932. First partition 914*a* additionally includes at least one aperture 920*a*, 922*a* enabling fluid communication between the chambers 924 and 932 inside muffler 900. Second partition 914*b* includes at least one aperture 920*b*, 922*b* enabling fluid communication between chambers 932 and 926. Optionally, sound absorbing material 916 may be placed in one or both first and second muffler chambers. No sound absorbing material is placed in chamber 932.

Extending through muffler 900 by passing through input header 910, partitions 914*a* and 914*b* and output header 912 is a through pipe comprised of an input section 902 and an output section 904. Pipe section 902 includes a first plurality of perforations 906 enabling an input section 902 to have fluid communication with the muffler chamber 924 surrounding it. Pipe section 904 has a second plurality of perforations 908 enabling fluid communication from the chamber 926 surrounding it to pipe section 904.

Positioned between the first and second set of perforations of the through pipe 902, 904 in chamber 932 is a valve assembly 100 arranged as previously described in conjunctions with FIGS. 1A-4B. Hence, in the closed position of valve assembly 100, exhaust will enter muffler 900 at the input end 928 of pipe section 902 as seen in FIG. 9 and will flow through perforations 906 into the sound absorbing material 916 surround the pipe in chamber 924. The exhaust then flows from the first chamber 924 to the second chamber 926 through chamber 932 via apertures 920*a*, 922*a* in partition 914*a* and then via apertures 920*b*, 922*b* in partition 914*b*. Finally, the exhaust flows from the second chamber 926 through perforations 908 in through pipe outlet section 904 and out an exit end 930 of the pipe section 904 as seen from FIG. 9.

When the exhaust pressure is high enough to overcome the force of bias spring 106, the valve flap 110 will open to a nearly horizontal position within pipe 902, 904 to essentially have most of the exhaust gas bypass the first and second chambers 924, 926 and their associated sound absorbing material 916. Since the flap 110 will be substantially horizontal in FIG. 9 in the fully open position, back pressure in muffler 900 is minimized.

Since no sound absorbing material is placed in chamber 932, there will be no interference between material 916 and those portions of valve assembly 100 located exteriorly of the through pipe 902, 904. This, in turn, simplifies construction and placement of material 916 inside chambers 924 and 926 of muffler 900.

Figure 10:
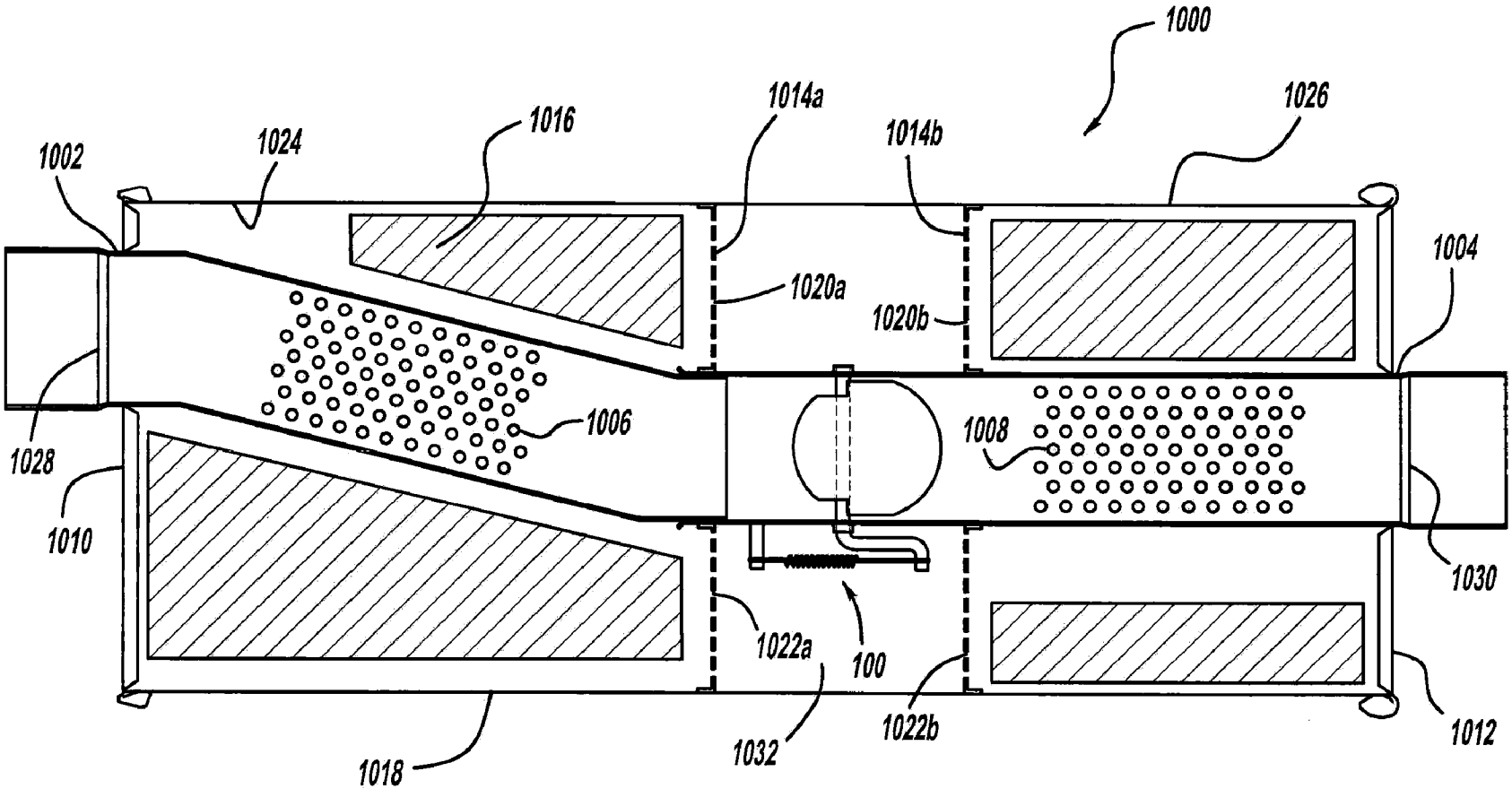
FIG. 10 is a side cross-sectional view of a second alternative embodiment of an exhaust muffler arranged with a flapper valve in accordance with the present teachings.

Yet another exemplary application of the disclosed valve assembly is for a second alternative automotive exhaust system muffler, such as that shown in FIG. 10. Muffler 1000 uses a so-called side in-center out muffler style wherein at least one of the muffler inlet and the muffler outlet is displaced from a central longitudinal axis of the muffler housing. In all other respects, muffler 1000 of FIG. 10 is substantially identical to muffler 900 of FIG. 9. It will be understood by those skilled in the art that the teachings herein are applicable also to mufflers having the inlet centered on the muffler axis and the outlet offset therefrom, or to mufflers having both the inlet and the outlet offset from the muffler longitudinal axis.

Muffler 1000 has a housing comprised of a substantially cylindrical outer shell 1018 closed at input and output ends by an input header 1010 and an output header 1012. A first partition 1014*a* is attached to outer shell 1018 at a position to define muffler chamber 1024 on a first side thereof. A second partition 1014*b* is attached to outer shell 1018 at a position to define a second muffler chamber 1026 on a first side thereof. The second sides of partitions 1014*a*, 1014*b* define a third muffler chamber 1032. First partition 1014*a* additionally includes at least one aperture at 1020*a*, 1022*a* enabling fluid communication between the chambers 1024 and 1032 inside muffler 1000. Second partition 1014*b* includes at least one aperture 1020*b*, 1022*b* enabling fluid communication between chambers 1032 and 1026. Optionally, sound absorbing material 1016 may be placed in one or both first and second interior muffler chambers. No such material is placed within chamber 1032.

Extending though muffler 1000 by passing through input header 1010, partitions 1014*a* and 1014*b* and output header 1012 is a through pipe comprised of an angular input section 1002 and a linear output section 1004. Section 1002 includes a first plurality of perforations 1006 enabling input section 1002 to have fluid communication with the muffler chamber 1024 surrounding it. Pipe section 1004 has a second plurality of perforations 1008 enabling fluid communication from the chamber 1026 surrounding it to pipe section 1004.

Positioned between the first and second set of perforations of the through pipe 1002, 1004 in chamber 1032 is a valve assembly 100 arranged as previously described in conjunction with FIGS. 1A-4B. Hence, in the closed position of valve assembly 100, exhaust will enter muffler 1000 at the input end 1028 of pipe section 1002 as seen in FIG. 10 and will flow through perforations 1006 into the sound absorbing material 1016 surrounding the pipe in chamber 1024. The exhaust then flows from the first chamber 1024 to the second chamber 1026 through chamber 1032 via apertures 1020*a*, 1022*a* in partition 1014*a* and then via apertures 1020*b*, 1022*b* in partition 1014*b*. Finally, the exhaust flows from the second chamber 1026 through perforations 1008 in through pipe outlet section 1004 and out and exit end 1030 of the pipe section 1004 as seen from FIG. 10.

When the exhaust pressure is high enough to overcome the force of bias spring 106, the valve flap 110 will open to a nearly horizontal position within pipe 1002, 1004 to essentially have most of the exhaust gas bypass the first and second chambers 1024, 1026 and their associated sound absorbing material 1016. Since the flap 110 will be substantially horizontal in FIG. 10 in the fully open position, back pressure in muffler 1000 is minimized.

Again, since no sound absorbing material is placed in chamber 1032, there will be no interference between material 1016 and those portions of valve assembly 100 located exteriorly of through pipe 1002, 1004. This offers the same advantages as set forth for muffler 900 of FIG. 9.

The invention has been described in conjunction with a detailed description of embodiments disclosed for the sake of example only. The scope and spirit of the invention are to be determined from an appropriate interpretation of the appended claims.

What is claimed is:

1. A muffler for an internal combustion engine exhaust system, the muffler comprising:

a housing having an outer shell and input and output headers enclosing opposite ends of the shell;

at least one partition inside the housing dividing a housing interior into first and second chambers, at least one of the chambers having sound absorbing material positioned therein, the at least one partition having at least one aperture therethrough providing for fluid communication between the first and second chambers;

a through pipe extending through the input and output headers and the at least one partition and having a plurality of perforations enabling fluid communication between the through pipe and the first chamber; and a valve assembly having a substantially planar valve flap positioned inside the through pipe for rotation about an axle pivotally coupled to the pipe between a fully closed position wherein a first peripheral portion of the valve flap is in contact with an inner surface of the through pipe and a fully open position wherein a plane of the valve flap is substantially parallel to a longitudinal axis of the through pipe and a second peripheral portion of the substantially planar valve flap is in contact with an inner surface of the through pipe.

2. The muffler of claim 1 wherein the valve flap in the fully closed position intersects the longitudinal axis of the through pipe at an acute angle.

3. The muffler of claim 1 further comprising:

a bias element forcing the valve flap toward the fully closed position, the bias element mounted exteriorly of the through pipe between the through pipe and the axle.

4. The muffler of claim 3 wherein exhaust pressure in the through pipe forces the valve flap to the fully open position whenever the exhaust pressure is high enough to overcome bias element force.

5. The muffler of claim 1 wherein the valve assembly is positioned on the through pipe in a muffler chamber substantially devoid of sound absorbing material therein.

6. A muffler for an internal combustion engine exhaust system, the muffler comprising:

a housing having an outer shell and input and output headers enclosing opposite ends of the shell;

first and second partitions inside the housing dividing a housing interior into first, second and third chambers, the first chamber defined by the first partition and the input header, the second chamber defined by the second partition and the output header, and the first and second partitions defining the third chamber therebetween, the first and second partitions having at least one aperture therethrough providing for fluid communication between the first and second chambers via the third chamber, the first and second chambers each having sound absorbing material positioned therein;

a through pipe extending through the input and output headers and the first and second partitions and having a first plurality of perforations enabling fluid communication between the through pipe and the first chamber, and a second plurality of perforations enabling fluid communication between the through pipe and the second chamber; and a valve assembly having a substantially planar valve flap positioned inside the through pipe in the third chamber between the first and second pluralities of through pipe perforations for rotation about an axle pivotally coupled to the pipe between a fully closed position wherein a first peripheral portion of the valve flap is in contact with an inner surface of the through pipe and a fully open position wherein a plane of the valve flap is substantially parallel to a longitudinal axis of the through pipe and a second peripheral portion of the substantially planar valve flap is in contact with an inner surface of the through pipe.

7. The muffler of claim 6 wherein the third chamber is substantially devoid of sound absorbing material.

8. The muffler of claim 6 wherein the through pipe passes through the input header at a position offset from a central longitudinal axis of the outer shell.

9. The muffler of claim 8 wherein the through pipe passes through the output header at a position substantially centered about the central longitudinal axis.

10. The muffler of claim 6 wherein the valve flap in the fully closed position intersects the longitudinal axis of the through pipe at an acute angle.

11. The muffler of claim 6 further comprising:

a bias element forcing the valve flap toward the fully closed position, the bias element mounted exteriorly of the through pipe between the through pipe and the axle.

12. The muffler of claim 11 wherein exhaust pressure in the through pipe forces the valve flap to the fully open position whenever the exhaust pressure is high enough to overcome bias element force.

* * * * *